US005936496A

United States Patent [19]

Kern

[11] Patent Number: 5,936,496

[45] Date of Patent: Aug. 10, 1999

[54] ELECTROMAGNETIC RELAY

[75] Inventor: Josef Kern, Berlin, Germany

[73] Assignee: Siemens Aktiengesellschaft, Munich, Germany

[21] Appl. No.: 08/994,067

[22] Filed: Dec. 19, 1997

[30] Foreign Application Priority Data

Dec. 19, 1996 [DE] Germany ..... 296 22 093 U

[51] Int. Cl.[6] ..... H01H 51/22

[52] U.S. Cl. ..... 335/80; 335/78; 335/128; 335/81; 335/82; 335/83; 335/124

[58] Field of Search ..... 335/78–86, 128, 335/124, 274, 203

[56] References Cited

U.S. PATENT DOCUMENTS 4,734,668 3/1988 Dittmann ..... 338/128

FOREIGN PATENT DOCUMENTS 0 393 226 4/1989 European Pat. Off. .
WO90/09028 8/1990 WIPO .

OTHER PUBLICATIONS

Patent Abstracts of Japan Application No. 59209515 dated Oct. 4, 1984.

*Primary Examiner*—Michael L. Gellner
*Assistant Examiner*—Tuyen T. Nguyen
*Attorney, Agent, or Firm*—Hill & Simpson

[57] ABSTRACT

An electromagnetic relay is provided with a coil body that is preferably composed of ceramic with a winding and a U-shaped core yoke whose ends are bridged by a flat armature. The armature actuates an insulating switching spring made of ceramic or a similar material that, crosses the armature at about a 90° angle, and extends between the ends of the core yoke and bridges two cooperating contacts at its movable end with a bridge contact. The relay can be utilized even in a very small design at high ambient temperatures.

19 Claims, 3 Drawing Sheets

ELECTROMAGNETIC RELAY

BACKGROUND OF THE INVENTION

Field of the Invention

The present invention relates to electromagnetic relays and, more specifically, to electromagnetic relays suitable for high temperature use.

A relay with a coil body serving as basic body, a U-shaped core yoke, and a plate-formed armature is known, for example, from the document WO 90/09028. The switching spring there is immediately connected to the armature, and, in addition, welded at the yoke via an angled off section. It serves as armature bearing spring as well as electric connection for the movable contacts.

In using such known relays at high heat load, namely at high surrounding temperature and/or with high self-heating due to the coil current and/or a high load current, the cross sections for the load circuit are necessarily overdimensioned in order to keep the dissipated power small. In addition, the coil has to be designed to reduce the dissipation of power and to provide a high winding wire volume. The contact and armature reset spring that is necessary in the standard construction has to be created from a material with slight relaxation behavior at high temperatures, i.e., for example from an expensive beryllium-alloyed copper spring material. These parameters physically limit the miniaturizing of the electromechanical relays for large loads at high ambient temperature.

SUMMARY OF THE INVENTION

The invention refers to an electromagnetic relay with a coil body that carries a coil winding between two flanges, a U-shaped core yoke that has one core leg extending axially through the coil winding and has one core leg extending parallel to it next to the coil, a flat armature that is arranged in the area of the first coil flange and that bridges the two end faces of the core legs and yoke leg given excitation of the coil, and at least one pair of fixed cooperating contact elements that are anchored in a plane next to one another in the first coil flange and are bridged by the movable end of the switching spring in a switch position of the armature.

In an embodiment, an electromagnetic relay in accordance with the present invention includes a coil body that comprises a coil winding disposed between a first flange and a second flange. The coil winding includes a open central area that accommodates a core leg of a U-shaped core yoke that comprises a core leg and a yoke leg. The core leg extends axially through the coil winding and the yoke leg extending parallel to the core leg but outside of the coil winding. The core leg and the yoke leg each terminate at an end face whereby the end faces of the core leg and the yoke leg are spaced apart and juxtaposed with respect to one another.

The first flange is connected to an armature which extends across the end faces of the core leg and the yoke leg. The armature engages a switching spring that is disposed between the armature and the first flange. The first flange is further connected to the switching spring at one end of the first flange with a second opposite end of the first flange being connected to a pair of spaced apart contact elements.

The switching spring comprises a contact bridge that is disposed at a distal end of the switching spring that extends between the contact elements and which engages both contact elements when the armature is drawn toward the coil winding resulting in a pressing of the switching spring forward so that the contact bridge engages both contact elements. The switching spring further is characterized as having an elongated shape so that it extends from one end of the first flange, across the first flange and between the end faces of the core leg and yoke leg before terminating at the contact bridge which is disposed parallel to the contact element when the coil and armature are inactivated. The switching spring further extends across the armature and in an plane approximately parallel thereto.

In an embodiment, the coil body is fabricated from a ceramic material.

In an embodiment, the switching spring is fabricated from a ceramic material.

In an embodiment, the coil body is fabricated from a high density or high temperature plastic.

In an embodiment, the armature is loosely connected to the first flange by a plurality of brackets and the armature exerts a biasing pressure on the switching spring at a central location thereof.

In an embodiment, the switching spring is further characterized as an elongated rectangular strip that is attached to one end of the first flange and which extends across the first flange to the contact elements which are disposed at a second opposing end of the first flange.

In an embodiment, the switching spring is biased towards the armature and away from the coil winding.

In an embodiment, the armature counteracts an outward bias of the switching spring away from the coil winding by pressing the switching spring towards the coil winding.

In an embodiment, the second flange further comprises a coil connection pin on which the winding ends of the coil winding are attached.

In an embodiment, the armature further comprises a centrally disposed actuation box disposed on a side of the armature that faces the switching spring. The actuating box engages the switching spring thereby causing the contact bridge to engage the contact element.

It is an object of the instant invention to provide a relay of the type stated above with an optimally simple design and optimally few individual parts, whereby the individual parts possess a simple form and can be assembled with optimally little processing, so that inexpensive materials can also be used and nevertheless the size can be kept small dependent on the application. Accordingly, the relay should be especially suitable for applications with high heat load.

This object is reached with a relay of the type mentioned in the above in that the switching spring is fastened in a peripheral area of the first coil flange, extends through the end sections of the core leg and the yoke leg, whereby it crosses the armature in a plane approximately parallel to it, and in that the switching spring carries a contact bridge that collaborates with the cooperating contact elements in a peripheral area of the coil flange opposite to the fastening location.

Thus, in the relay of the present invention, the switching spring does not need to gate any load current since this flows only through the bridge contact at the end of the switching spring. The switching spring also does not need to take on a bearing function for the armature, thus, it does not have to be bent and can be produced from relatively stiff material of the most simple formation without later processing. The spring, however, can be produced from metal, high temperature-resistant plastic materials or ceramics material. Ceramics are suitable due to a low relaxation behavior at a high heat load and for a desired insulation between the load current circuit and the magnetic circuit.

According to the demands made of the temperature durability, the coil body can be produced either from a high-density plastic or preferably from ceramics. The switching spring is preferably fastened in a slot of the first coil flange, for example by a hard soldering. The spring can be fastened obliquely in the slot in order to create a bracing of the switching spring towards the armature. An especially simple construction results in that the armature is arranged without a bearing fastening in the shape of a rectangular plate in a recess of the first coil flange and instead is secured by holding noses or brackets. A captive holding of the armature can be achieved in that it comprises a rated bending location by which it is inserted in a slightly buckled state between the brackets and by later bending brought into a stretched state.

Other objects and advantages of the present invention will become apparent upon reading the following detailed description and appended claims, and upon reference to the accompanying drawing.

BRIEF DESCRIPTION OF THE DRAWING

For a more complete understanding of the present invention, reference should now be made to the embodiment illustrated in greater detail in the accompanying drawing and described below by way of an example of the invention.

In the drawing.

Figure 1:
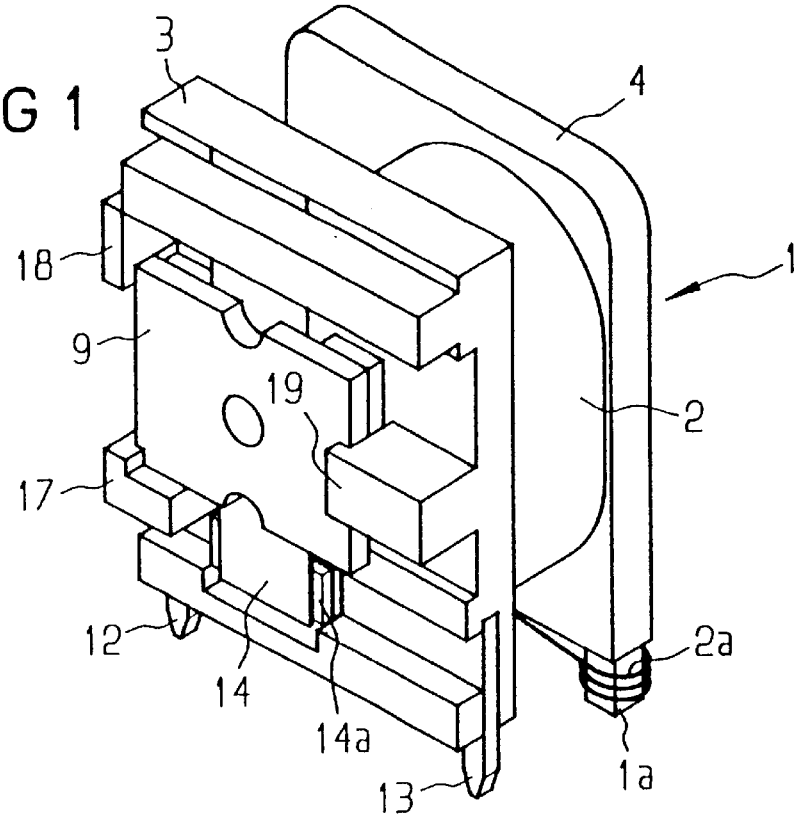
FIG. 1 is a perspective view of a relay designed according to the present invention.

It should be understood that the drawing is not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The relay depicted in the drawing includes a coil body 1 of ceramic material that serves both as basic body and support for the functional elements. A coil winding 2 is mounted on the coil body 1, the winding 2 is bound by a first flange 3 and a second flange 4. A U-shaped core yoke 5 is pinned with a core leg 6 through an axial opening 7 of the coil body 1 whereas a yoke leg 8 extends parallel thereto next to the coil 2. The core leg 6 and the yoke leg 8 form pole surfaces 6*a* and 8*a* at the face end that are aligned with one another to form two working air gaps with a plate-shaped armature 9.

The coil body 1 is composed of ceramic material and is preferably produced in a powder die-cast process. In addition, two coil connections 1*a* are immediately attached to the second flange 4 so that they can be directly wrapped around with the wiring ends 2*a* of the coil 2. Thereby, the temperature-stable coil body 1 can be immediately soldered in a printed circuit board.

In the first coil flange 3, there are two drawer-like chambers 10 and 11 formed near the underside into which two cooperating contact supports 12 and 13 are inserted from opposing sides. In addition, a ceramic spring is provided as a switching spring 14 of simple rectangular shape that is attached with the one end in the upper area of the first coil flange 3 in a slot 15 which is formed there. The attachment can thereby be carried out, for example, by soldering, by casting or via ceramic cement. On its other end, the switching spring 14 carries a transversely lying contact band that collaborates as bridge contact 14*a* with the two stationary cooperating contacts 12*a* and 13*a*, thus bridging them when the armature is attracted. The bridge contact 14*a* can be connected to the switching spring that is pregalvanized in this area through a soldering. Thus, the flat switching spring 14 is clamped obliquely outward so that it receives a prestress in the direction of the armature and provides the resetting power needed for it.

The armature 9 is arranged freely movable in a recess 16 of the coil body flange 3 and is secured captive by stops as well as holding noses or brackets 17, 18, and 19 on all sides. It possesses a ball-shaped pressure boss 20 in the center with which, in the point of intersection, it actuates the switching spring that is arranged turned by 90° to the horizontal extension of the armature. The power of the magnetic system in the example depicted is transferred to the bridge contact 14*a* approximately with a transformation ratio of 2:1. The spring 14 presses the armature against the brackets 17, 18, and 19 in the unenergized state of the armature 9.

Figure 5:
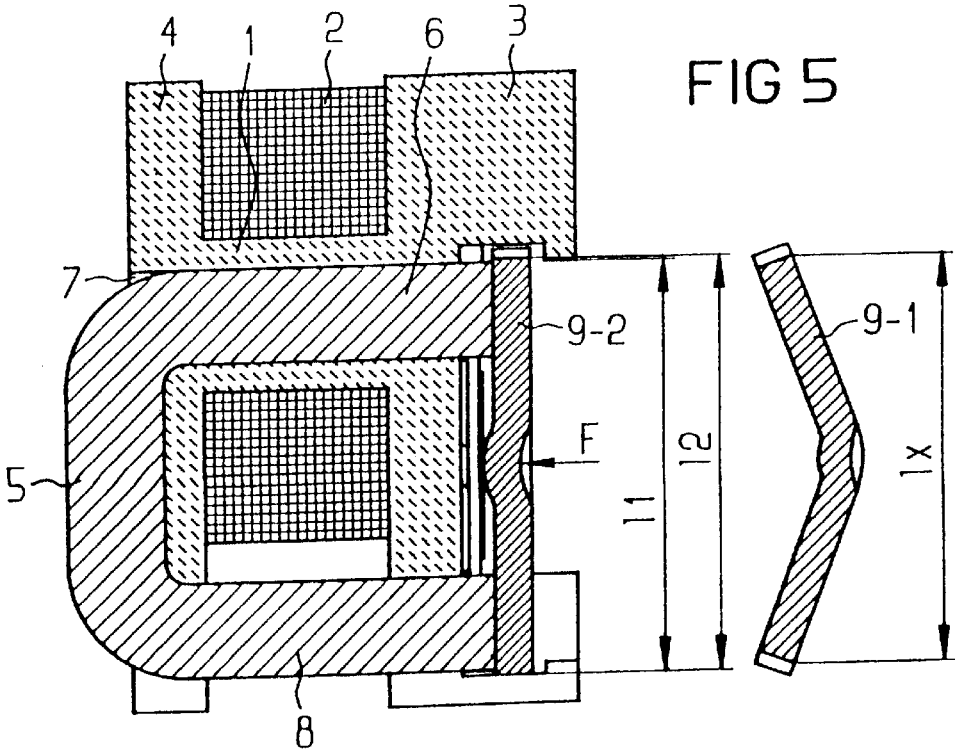
FIG. 5 is the sectional view of FIG. 4 with a drawing of the armature mounting.
Figure 2:
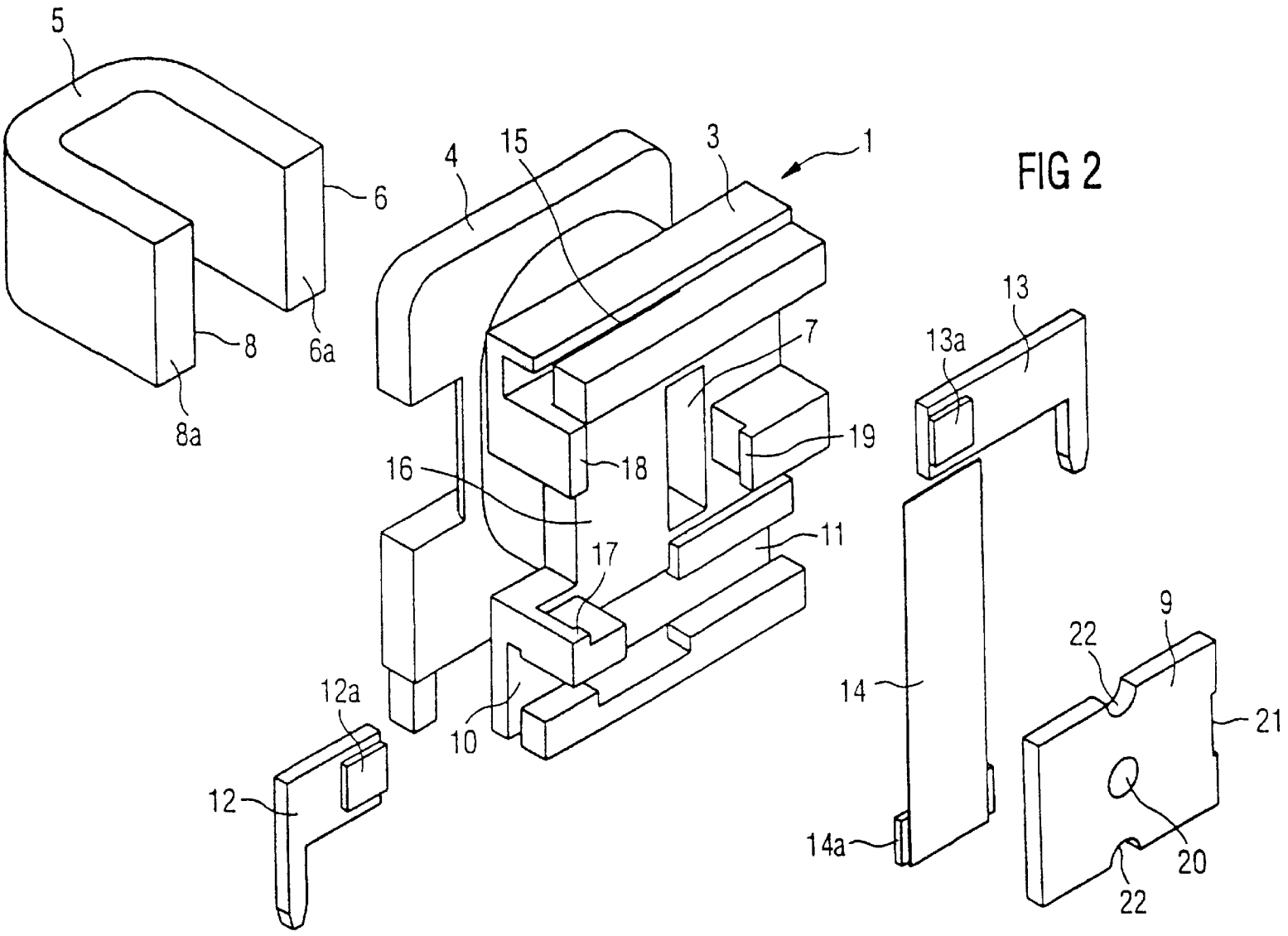
FIG. 2 is an exploded view of the individual parts of the relay shown in FIG. 1.

The mounting of the armature 9 ensues according to the schematic depiction in FIG. 5 in such a way that it first, is angled in the shape of a V (see the armature as illustrated in FIG. 5 as state 9-1); the length 1*x* of the armature is shortened in this state in the area of the side recess 21 so that 1*x* is smaller than the length 11 which indicates the opening length of the recess 16 at the bracket 19. Thus, the armature can be inserted into the recess 16 past the bracket 19 in this state 9-1. Then, the armature is deformed by the application of a force F from the back side of the actuation boss 20 along a rated bending location that is formed by constrictions 22 until it is almost flat and assumes the length 12. It is held captive with this length 12 behind the brackets 17, 18, and 19.

Due to the crossed arrangement of the switching spring 14 relative to the armature, whereby the switching spring 14 is arranged in a parallel plane to the armature, but, rotated by 90° to the longitudinal extension of the armature, it is assured that no internal mounting strains exist in the relatively brittle, but nevertheless sufficiently resiliently ceramic switching spring which could lead to a breakage. The arrangement of the armature in relation to the two pole surfaces 6*a* and 8*a* is not affected by this crossed arrangement of the spring since the switching spring 14 lies in the free area between the end portions of the core leg 6 and the yoke leg 8.

Figure 3:
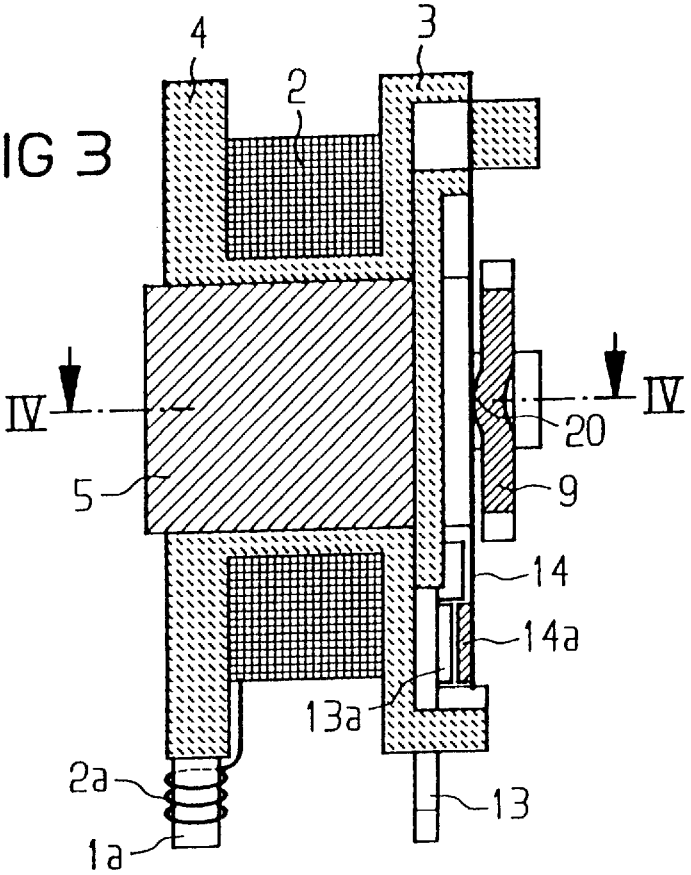
FIG. 3 is a sectional view of the relay taken substantially along line III—III of FIG. 4.
Figure 4:
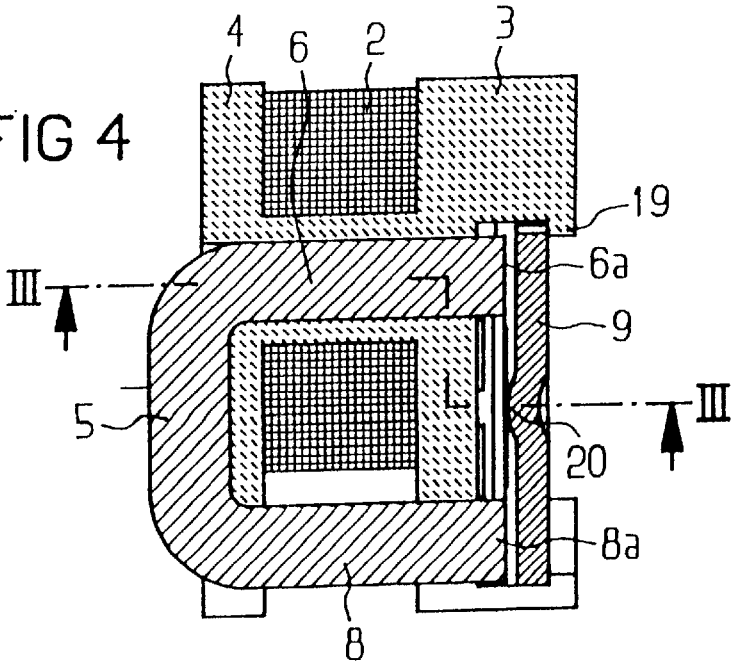
FIG. 4 is a sectional view of the relay taken along line IV—IV of FIG. 3.

Sections III—III and IV—IV in longitudinal and transverse directions are illustrated in FIGS. 3 and 4. The installation planes of the function parts of the relay are located primarily in the first coil flange 3 for ease of assembly. Since a relaxation and therewith a later change of the mechanical properties is not to be expected at high temperatures, smaller paths and forces can be provided than in conventionally built relays given at the same life span. The relay can be operated at higher temperatures with a low impedance coil, smaller cross sections for the electric load circuit and the magnetic circuit can also be used in comparison to the conventional relays at higher temperatures whereby less material is consumed. Thus, it can also be inserted into exposed positions with high ambient temperatures.

When the temperature straining is not too excessive and a sintered ceramic base part for the coil body is not needed, a coil body can also be utilized of a high-filled thermoplastic, for example with mineral, ceramic or glass fillers. Of course, the relay can also be provided with SMD connections if needed. The contact arrangement can also form a bridge opener or a bridge changer instead of the bridge closer which is depicted.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. An electromagnetic relay comprising:

a coil body comprising a coil winding disposed between a first flange and a second flange, the coil winding accommodating a core leg of a U-shaped core yoke that comprises the core leg that extends axially through the coil winding and a yoke leg that extends parallel to the core leg but outside of the coil winding, the core leg and the yoke leg each terminating at an end face, the end faces of the core leg and the yoke leg being spaced apart and juxtaposed relationship with respect to one another, the first flange being connected to an armature, the armature extending between the end faces of the core leg and the yoke leg, the armature engaging a switching spring that is disposed between the armature and the first flange, the first flange further being connected to the switching spring at one end of the first flange, the first flange also being connected to a pair of spaced apart contact elements at an opposite end of the first flange, the switching spring comprising a contact bridge disposed at a distal end thereof that extends between the contact elements and engages both contact elements when the armature is drawn toward the coil winding, the switching spring is further characterized as extending from the one end of the first flange, between the end faces of the core leg and the yoke leg and across the armature in a plane approximately parallel thereto before terminating at the contact bridge.

2. The relay of claim 1 wherein the switching spring is fabricated from a ceramic material.

3. The relay of claim 1 wherein the coil body is fabricated from a ceramic material.

4. The relay of claim 1 wherein the coil body is fabricated from a high density plastic.

5. The relay of claim 1 wherein the armature is loosely connected to the first flange by a plurality of brackets and the armature engages and exerts pressure on the switching spring at a central actuation area thereof.

6. The relay of claim 1 wherein the switching spring is characterized at being an elongated rectangular strip that attached to the one end of the first flange by inserting a proximal end of the strip into a slot disposed in the one end of the first flange.

7. The relay of claim 1 wherein the switching spring is biased towards the armature and away from the coil winding.

8. The relay of claim 1 wherein the armature is characterized as being a rectangular plate that is attached to the first flange by a plurality of brackets.

9. The relay of claim 1 wherein the second flange further comprises a coil connection pin on which winding ends of the coil winding are attached.

10. The relay of claim 1 wherein the armature further comprises an actuation boss disposed on a side of the armature facing the switching spring, the actuation boss for engaging the switching spring and causing the contact bridge to engage the contact elements.

11. An electromagnetic relay comprising:

a coil body comprising a coil winding disposed between a first flange and a second flange, the coil winding accommodating a core leg of a U-shaped core yoke that comprises the core leg that extends axially through the coil winding and a yoke leg that extends parallel to the core leg but outside of the coil winding, the first flange being connected to an armature, the armature extending across the core leg and the yoke leg, the armature engaging a switching spring that is disposed between the armature and the first flange, the first flange also being connected to a pair of spaced apart contact elements, the switching spring comprising a contact bridge disposed at a distal end thereof that extends between the contact elements and engages both contact elements when the armature is drawn toward the coil winding, the switching spring extending between the core leg and the yoke leg and across the armature in a plane approximately parallel thereto before terminating at the contact bridge.

12. The relay of claim 11 wherein the switching spring is fabricated from a ceramic material.

13. The relay of claim 11 wherein the coil body is fabricated from a ceramic material.

14. The relay of claim 11 wherein the coil body is fabricated from a high density plastic.

15. The relay of claim 11 wherein the armature is connected to the first flange by a plurality of brackets and the armature engages and exerts pressure on the switching spring at a central actuation area thereof.

16. The relay of claim 11 wherein the switching spring is characterized at being an elongated rectangular strip that attached to the first flange by inserting a proximal end of the strip into a slot disposed in the first flange.

17. The relay of claim 11 wherein the switching spring is biased towards the armature and away from the coil winding.

18. The relay of claim 11 wherein the second flange further comprises a coil connection pin on which winding ends of the coil winding are attached.

19. An electromagnetic relay comprising:

a ceramic coil body comprising a coil winding disposed between a first flange and a second flange, the coil winding accommodating a core leg of a U-shaped core yoke that comprises the core leg that extends axially through the coil winding and a yoke leg that extends parallel to the core leg but outside of the coil winding, the core leg and the yoke leg each terminating at an end face, the end faces of the core leg and the yoke leg being spaced apart and juxtaposed relationship with respect to one another, the first flange being connected to an armature by a plurality of brackets disposed around outer edges of the armature, the armature extending between the end faces of the core leg and the yoke leg, the armature comprised a centrally located actuation boss for engaging a ceramic elongated rectangular switching spring that is disposed between the armature and the first flange, the first flange further being connected to the switching spring at one end of the first flange, the first flange also being connected to a pair of spaced apart contact elements at an opposite end of the first flange, the switching spring comprising a contact bridge disposed at a distal end thereof that extends between the contact elements and engages both contact elements when the armature is drawn toward the coil winding, the switching spring is further characterized as extending from the one end of the first flange, between the end faces of the core leg and the yoke leg and across the armature in a plane approximately parallel thereto before terminating at the contact bridge, the second flange further comprising a coil connection pin on which winding ends of the coil winding are attached.

* * * * *